United States Patent [19]

Onaka et al.

[11] Patent Number: 4,611,568

[45] Date of Patent: Sep. 16, 1986

[54] INTERNAL COMBUSTION ENGINE WITH BY-PASS CONTROL SYSTEM FOR SUPERCHARGER

[75] Inventors: Hidemi Onaka; Toyokazu Baika; Yoshiaki Shibata; Kingo Horii, all of Susono; Yasushi Sato, Mishima, all of Japan

[73] Assignee: Toyota Jidosha Kabushiki Kaisha, Aichi, Japan

[21] Appl. No.: 749,795

[22] Filed: Jun. 28, 1985

[30] Foreign Application Priority Data

Jul. 2, 1984 [JP] Japan ..... 59-98468[U]

[51] Int. Cl.[4] ..... F02B 33/38

[52] U.S. Cl. ..... 123/559; 123/564

[58] Field of Search ..... 60/600, 601, 611; 123/559, 564

[56] References Cited

U.S. PATENT DOCUMENTS 2,660,991 12/1953 Wasielewski ..... 123/564 X
4,485,793 12/1984 Oguma ..... 123/559

FOREIGN PATENT DOCUMENTS 15626 1/1984 Japan ..... 123/559
18226 1/1984 Japan ..... 123/559
18227 1/1984 Japan ..... 123/559
28044 2/1984 Japan ..... 123/559

*Primary Examiner*—Michael Koczo
*Attorney, Agent, or Firm*—Parkhurst & Oliff

[57] ABSTRACT

A bypass control system for an internal combustion engine provided with a mechanical supercharger arranged in an intake pipe of the engine. The supercharger is connected to a crankshaft by means of a clutch operated in accordance with the engine load as well as the engine speed. A by-pass is arranged so as to by-pass the supercharger, on which by-pass a by-pass control valve is arranged. The by-pass control valve is operated in accordance with the engine speed, so that it is closed during an engine high load and high speed condition. The by-pass valve is further operated in response to the condition of the clutch so that the by-pass is closed when the clutch is under the disengaged state.

7 Claims, 6 Drawing Figures

INTERNAL COMBUSTION ENGINE WITH BY-PASS CONTROL SYSTEM FOR SUPERCHARGER

BACKGROUND OF THE INVENTION

1. Field of the Invention

The present invention relates to an internal combustion engine with a by-pass control system.

2. Description of the Related Art

In an internal combustion engine provided with a mechanical supercharging system, a Roots blower is connected as a supercharger to an engine crankshaft by way of a clutch. The clutch is engaged or disengaged in accordance with the engine load, engine speed, and other engine conditions. The clutch is engaged when the engine load is high to obtain a high engine torque. Furthermore, the clutch is engaged at a predetermined engine speed in order to prevent possible shock or damage to the clutch arising from engagement at higher engine speeds.

In one known supercharging device with a clutch, a by-pass is provided. A by-pass control valve is arranged in the by-pass to allow operation in accordance with engine load (see Japanese Unexamined Patent Publication (Kokai) No. 56-167817). The by-pass control valve is used to control the amount of supercharging air during the supercharging state of the engine where the clutch is engaged. When the engine load is high, the by-pass control valve is closed, so that no diversion of air into the by-pass occurs and the pressure of air into the engine become high, thus enabling high engine output. When the engine load becomes small, the by-pass control valve is opened. The air from the supercharger is thus diverted to the by-pass, and the pressure of air into the engine decreases. This decreases the effort required for attaining compression in the supercharger and increases fuel consumption efficiency.

In this prior art system, however, the control of the supercharger by the clutch and the control of the by-pass are independent. Therefore, there is an area where the clutch is changed from disengaged to engaged state while the by-pass is maintained open. In this case, there is a certain delay in the increase in speed of the supercharger after the clutch engagement due to the relatively low speed of the supercharger, caused by the small amount of air passing through the supercharger, just before the clutch engagement. The delay makes the engine torque become small. Note that there is a tendency toward the temporary decrease in torque when the clutch is engaged due to the inertia effect. The drop is amplified by the opened state of the by-pass.

SUMMARY OF THE INVENTION

An object of the present invention is to provide a system capable of preventing the temporary decreases in the engine torque when the clutch is engaged.

According to the present invention, there is provided an internal combustion engine including an engine body; an intake system connected to the engine body for introducing air into the engine body; an exhaust system connected to the engine body for removal of the combustion product from the engine body; a mechanical pump arranged as a supercharger in the intake system; clutch means for connecting kinematically the supercharger to the engine for driving the supercharger; actuator means responsive to engine load for selectively operating the clutch means; a by-pass having a first end connected to the intake system at a position downstream of the supercharger and a second end connected to the intake system at a position upstream from the supercharger; by-pass valve means arranged in the by-pass for controlling the by-pass of the air into the by-pass from the supercharger; first means for producing a by-pass operating signal directed to the by-pass valve means for closing the by-pass when the engine load is high; and, second means for producing a by-pass operating signal directed to the by-pass valve means for closing the by-pass during a low load condition of the clutch means.

DESCRIPTION OF A PREFERRED EMBODIMENT

Figure 1:
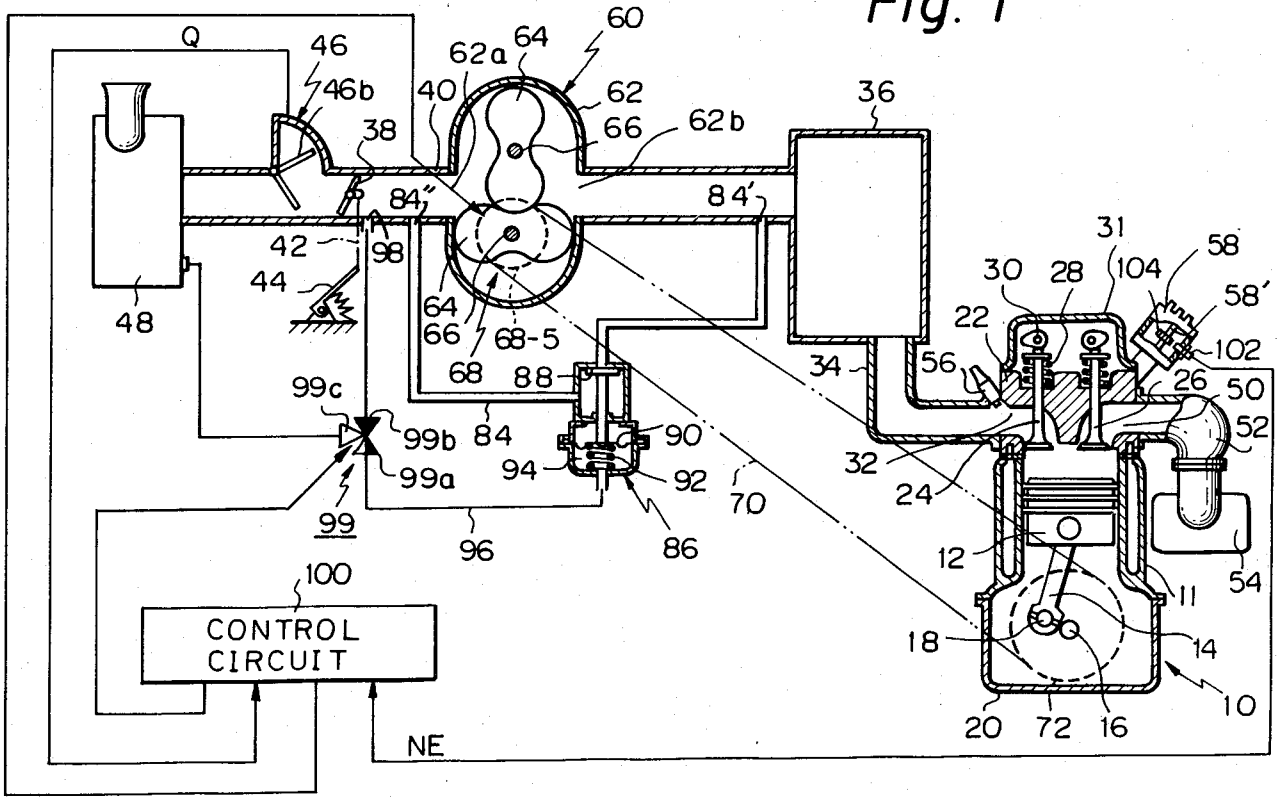
FIG. 1 is a general view of an internal combustion engine according to an embodiment of the present invention.

In FIG. 1, reference numeral 1 denotes an engine body, 11 a cylinder block, 12 a piston, 14 a connecting rod, 16 a crankshaft, 20 an oil pan, 22 a cylinder head, 24 an intake valve, 26 an exhaust valve, 28 valve springs, 30 camshafts, and 31 a camshaft housing.

The cylinder head 22 has an intake port 32 which is connected to a surge tank 36 by way of an intake pipe 34. A throttle valve 38 is arranged in an intake pipe 40. The throttle valve 38 is connected to an accelerator pedal 44 by means of a link 42. An air flow meter 46 is arranged upstream from the throttle valve 38. An air cleaner 48 is arranged upstream of the air flow meter 46.

The cylinder head 22 has an exhaust port 50 which is connected to a catalytic converter 54 via an exhaust manifold 52.

In this embodiment, the internal combustion engine is a fuel injection type provided with a fuel injector 56 arranged in the intake pipe 34. Reference numeral 58 denotes a distributor for supplying high voltage from an ignition coil (not shown) to a spark plug (not shown) arranged in the combustion chamber.

According to the present invention, a Roots blower 60 is arranged in the intake pipe 40 downstream from the throttle valve 38 as a mechanical supercharger. The Roots blower 60 has a housing 62, and a pair of rotors 64 of a cocoon shape arranged in the housing 62. The rotors 64 have shafts 66 having wheels (not shown) meshing with each other, so that the rotors 64 rotate oppositely in the housing 62 while a small clearance is maintained between the rotors 64 and the inner periphery of the housing 62, whereby fluid is sucked from an inlet **62*a* and is forced out of an outlet 62*b*. One of the rotors 64 has a clutch 68 provided with a pulley 68-5 (FIG. 2) which is connected, via a belt 70 to a pulley 72 on the crankshaft 16, so that the Roots blower 60 is rotated by the rotation of the crankshaft 16**.

Figure 2:
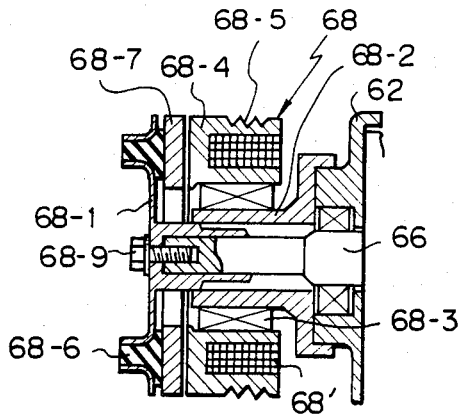
FIG. 2 is a longitudinal cross-sectional view of a clutch device in FIG. 1.

As shown in FIG. 2, the clutch 68 has a circular plate 68-1 connected by means of a bolt 68-9 to an end of the shaft 66 projecting out of the housing 62 of the Roots blower 60. A solenoid holder 68-4 is rotatably arranged, via a bearing unit 68-3, on a sleeve 68-2 which is fixedly connected to the housing 62 of the Roots blower 60. The pulley 68-5 shown also in FIG. 1 is formed on the outer periphery of the solenoid holder 68-4. The belt 70 in FIG. 1 loops around the pulley 68-5. An engaging member 68-7 of a disk shape is connected to the circular plate 68-1 via a plurality of angularly spaced resilient elements 68-6, so that the engaging member 68-7 faces the solenoid holder 68-4 at a small distance. The facing surfaces of these parts 68-7 and 68-4 construct friction engaging surfaces. An annular solenoid 68' is arranged in an annular space formed inside of the solenoid holder 68-4. The solenoid is steadily supported on the sleeve 68-2 by means of stay members (not shown). The resilient elements 68-6 urge the engaging member 68-7 so that the member 68-7 is detached from the solenoid holder 68-4 when the solenoid 68' is de-energized. In this case, the rotation of the solenoid holder 68-4, which always rotates due to the roation of the engine, cannot be transmitted to the shaft 66 of the pump 60. Thus, the supercharging does not occur. When the solenoid 68' is energized, the engaging member 68-7 is moved toward the solenoid holder 68-4 against the force of the resilient element 68-6 so that the frictional engaging surfaces of the parts 68-4 and 68-7 are engaged with each other. As a result, rotation of the solenoid holder 68-4, which always rotates due to the rotation of the engine, is transmitted to the shaft 66 of the blower.

Reference numeral 84 is a by-pass. One end 84' of the by-pass is connected to the intake pipe at the position between the supercharger 60 and the surge tank 36. The other or downstream end 84'' of the by-pass 84 is connected between the throttle valve 38 and the supercharger 60. A by-pass control valve 86 is arranged on the by-pass 84. The by-pass control valve 86 is of a diaphragm operated type, having a valve member 88, a diaphragm 90, and a vacuum operating chamber 94. The vacuum operating chamber 94 is connected, via a vacuum pipe 96, to a vacuum take-out port 98 formed in the intake line at a position between the throttle valve 38 and the supercharger 60. The vacuum take-out port 98 may be located on a position other than illustrated downstream from the throttle valve 38.

A three-way solenoid valve 99 is arranged on the vacuum pipe 96 connecting the vacuum operating chamber 94 of the by-pass control valve 86 with the vacuum take-out port 98. When energized, the valve 99 is positioned with the port **99*a* connected to the port 99*b*, so that the vacuum operating chamber 94 is opened to the vacuum take-out port 98. When de-energized, the valve 99 is positioned with the port 99*a* connected to the port 99*c* opened to the air cleaner 48. As a result, the vacuum operating chamber 94** is opened to the atmospheric pressure.

Figure 3:
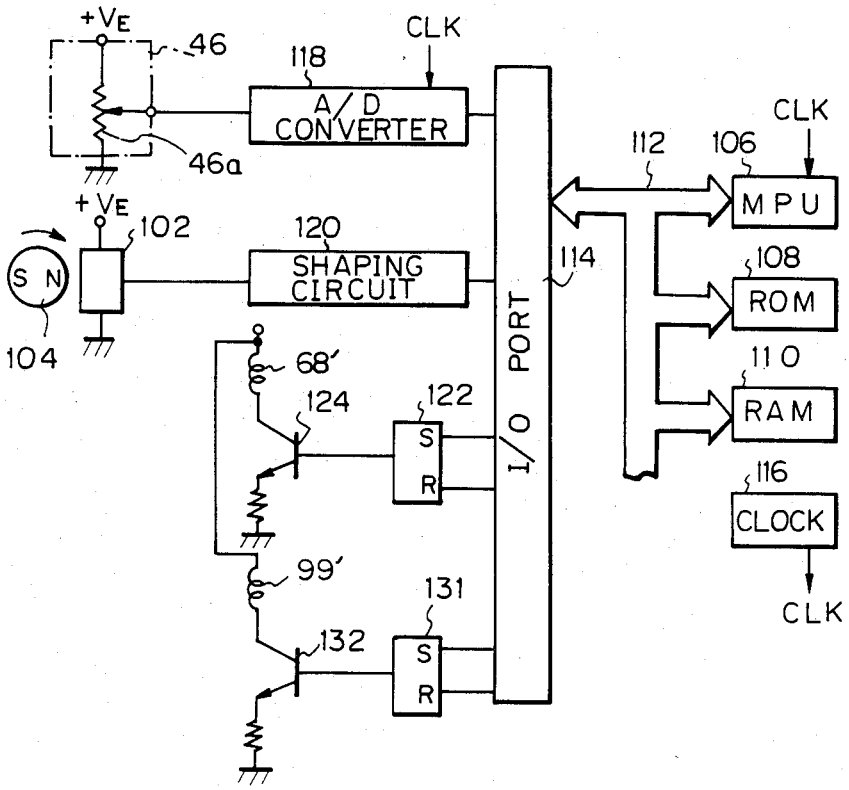
FIG. 3 is a block diagram of the control circuit in FIG. 2.

Reference numeral 100 denotes a control circuit for operating the clutch 68 and the solenoid valve 99. The control circuit 100 is adapted for issuing, in response to signals from a group of sensors detecting operating conditions of the engine, signals for operating the clutch 68 and the valve 99. The control circuit 100 may additionally include means for controlling the air-fuel ratio as well as ignition timing. The control circuit 100 can be constructed just to operate the clutch 68 and the valve 99. The sensor group is provided with the air flow meter 46 and an engine speed sensor 102 arranged on the distributor 58. As shown in FIG. 3, the air flow meter 46 is constructed as a potentiometer **46*a* connected to a measuring plate 46*b* (FIG. 1) capable of rotating in accordance with the amount of the air, so as to provide an analog signal Q indicating the amount of the intake air. The engine speed sensor 102 is constructed as a Hall element facing a magnet piece 104 arranged on a distributor shaft 58' of the distributor 58 connected to the crankshaft 16** so as to provide digital signals N indicating the rotational speed of the engine.

The control circuit 100 has the construction as shown in FIG. 3. The control circuit 100 is formed as a microcomputer system, having a microprocessing unit (MPU) 106, a read-only memory (ROM) 108, a random-access memory (RAM) 110, a bus 112 connecting these parts with each other, and a clock pulse generator 116. The air flow meter 46 is connected to an input-output (I/O) port 114 via an analog to digital (A-D) converter 118. The engine speed sensor 102 is connected to the I/O port 114 via a shaping circuit 120. Furthermore, the I/O port 114 is connected to a latch 122 which is connected to a base of a transistor 124. A solenoid 68' of the clutch is located in a collector-emitter circuit of the transistor 124. A latch 131 is further provided so as to be connected to the I/O port 114. The latch 131 is connected to a base of a transistor 132. The transistor has an emitter-collector circuit in which a solenoid 99' of the valve 99 is arranged.

When the control circuit 100 is also intended for controlling various engine operations, such as the air-fuel ratio and ignition timing, in addition to clutch control, various sensors as well as actuators are connected to the I/O port 114. These, however, are not shown in the drawing since they are not directly related to this invention.

The ROM 108 is provided with programs for operating the clutch 68 as well as the solenoid valve 99 in accordance with the present invention as well as for operating other engine states. The programs, which are directly related to the present invention, will be described with reference to the attached drawings.

Figure 4:
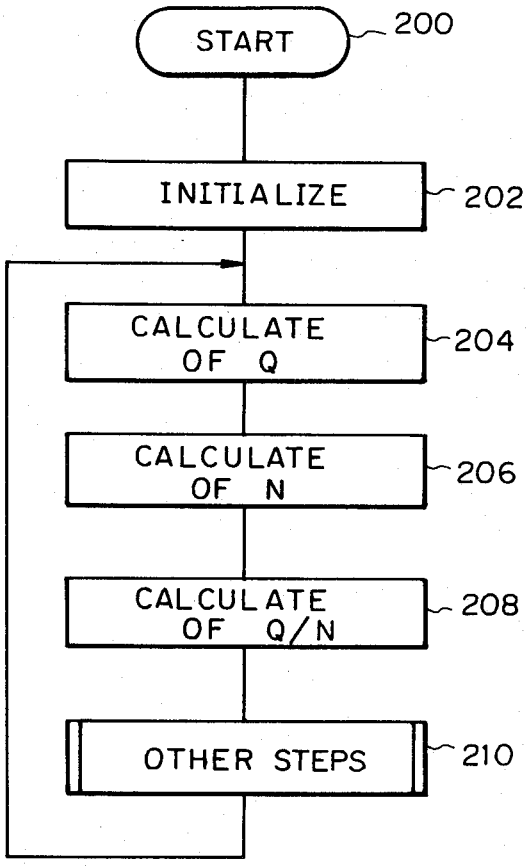
FIGS. 4 and 5 are flow charts illustrating the operation of the present invention.

FIG. 4 is a flow chart of a main routine, wherein various steps are executed, required to be quickly treated. At point 200, the program is started. At point 202, registers in the MPU 106, RAM 110, and I/O port 114 are initialized. At point 204, an intake air amount Q is calculated by the signal from the air flow meter 46, which amount is transformed into a digital signal. The calculated data of the intake air amount is stored in a predetermined area of the RAM 110. At point 206, the engine speed N is calculated from the pulse signals from the engine speed sensor 102. The calculated data related to the engine speed N is stored in a predetermined area of the RAM 110. At point 208, a ratio Q/N of the amount of intake air to the engine speed is calculated and the corresponding data stored in the predetermined area of the RAM 110. The ratio Q/N indicates the engine load, as well known to those skilled in this art. The point 210 indicates generally various other steps to be executed in the main routine.

Figure 5:
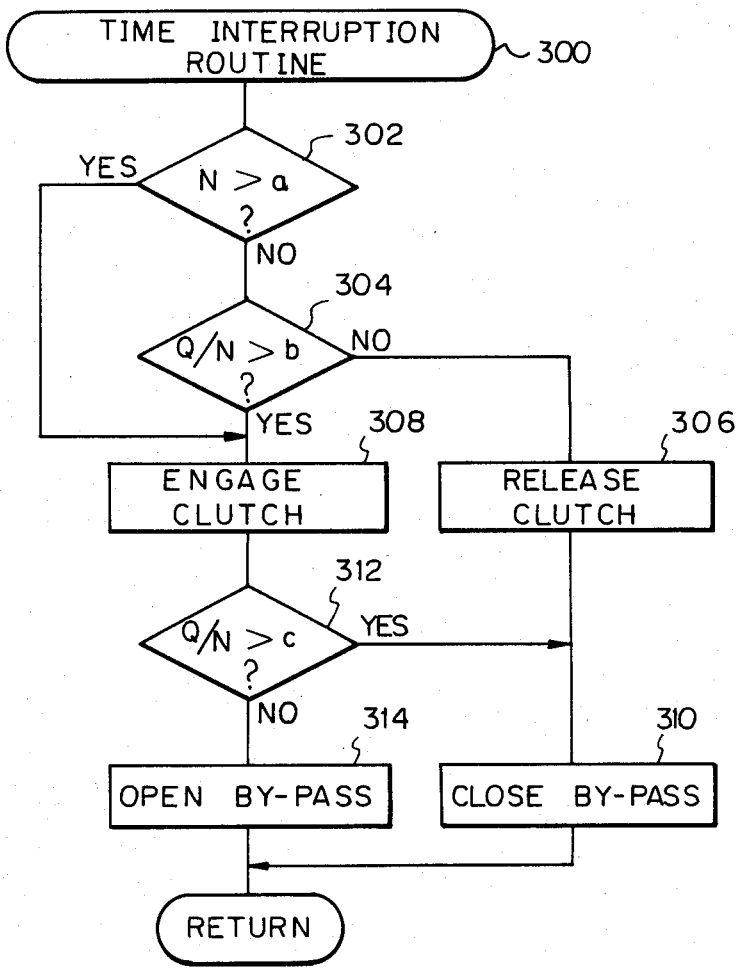

FIG. 5 indicates a routine for operating the clutch 68. This routine is a time interruption routine effected at a predetermined time interval, such as 35 msec. An interruption requirement signal is input to an interruption port of the MPU 106 at predetermined periods to execute the routine at point 300. At the following point 302, it is judged whether the engine speed N is higher than a predetermined value a, and, at a point 304, it is judged whether the ratio Q/N is larger than a predetermined value b. As shown by an operational diagram in FIG. 6, when the engine speed N is lower than a predetermined level a ("No" at the point 302) and when the ratio Q/N is smaller than a predetermined level b ("No" at the point 304), the engine is under a condition where the supercharger 60 should not be operated. In this case, the program proceeds to a point 306, where a high level signal is applied to the reset terminal of the latch 122 from the I/O port 114. As a result, a low level signal appears at the output of the latch 122, causing the transistor 124 to go OFF. As a result, the solenoid 68' is de-energized, causing the clutch 68 to be disconnected, so that no positive transmission of the rotation of the engine to the supercharger 60 takes place. Only free rotation of the rotors 64 takes place due to the flow of air directed from the throttle valve 38 to the surge tank 36, and therefore no supercharging takes place.

Figure 6:
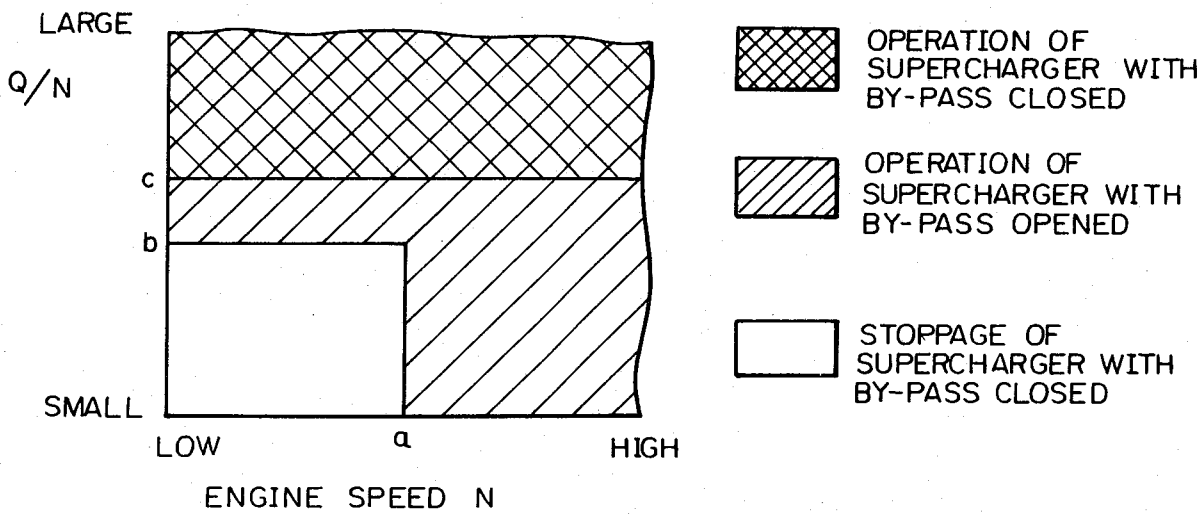
FIG. 6 is a diagram indicating how the supercharger and by-pass are operated.

When the engine speed N is larger than the predetermined value a ("Yes" at the point 302) or when the ratio Q/N is larger than the predetermined value b ("Yes" at the point 304), the engine is under a state where the supercharger 60 should be operated, as shown by the shaded area in FIG. 6. In this case, the program proceeds to a point 308, where a high level signal is applied to the set terminal of the latch 122, causing a high level signal to appear at the output of the latch 122. As a result, the transistor 124 is made ON, so that the solenoid 68' is energized, causing the clutch 68 to be engaged. Therefore, the rotation of the crankshaft 16 is transmitted via the pulley 72, the belt 70, pulley 68-5 (FIG. 2), solenoid holder 68-4, and engaging member 68-7 to the shaft 66 of the rotors 64. Thus, the rotors 64 are rotated oppositely, causing air from the throttle valve 38 to be sucked into the supercharger 60. The air from the supercharger 60 is forced via the surge tank 36, intake pipe 34, and the intake port 32 into the engine combustion chamber. The predetermined value a of the engine speed and the predetermined value b of the ratio Q/N, which determine whether the supercharger 60 is operated or not, should be determined by considering the following. The switching point should be located in as low an engine speed area as possible in order to decrease shock occurring when the clutch is switched from a release condition to an engaged condition as well as in order to prevent the frictional elements of the clutch from being quickly damaged. Contrary to this, the switching point should be located in as high a speed area as possible in order to increase the fuel consumption efficiency. Therefore, the switching point, i.e., the value of a and b, are determined in consideration of coordination between the requirements.

Following the above-mentioned control of the clutch, control of the by-pass control valve 86 is attained. When the engine is under the state where the clutch 68 is disengaged, the routine goes from the point 306 to a point 310 where a high level signal is issued from the I/O port 144 to the reset terminal of the latch 131, so that the transistor 132 for operating the valve 99 is made OFF. Thus, the valve attains a position where the vacuum operating chamber 94 of the control valve 86 is opened to the atmosphere. Thus, a spring 92 urges the diaphragm 90 so that the valve member 88 assumes a closed position, so as to close the by-pass 84. This means that no by-pass occurs during the non-supercharging state where the clutch 68 is engaged, allowing the full amount of air to be introduced into the engine. See non-shaded area in FIG. 6.

When the engine is under the state where the clutch 68 is engaged so as to attain the supercharging operation, the routine goes from the point 308 to a point 312, where it is judged whether the ratio of the intake air amount to the engine speed, Q/N, which is parameter of the engine load, is larger than a predetermined value c, which is larger than b, at step 304 (See Step 304). When Q/N is lower than c, the program proceeds to a point 314, where a high level signal is issued to a set terminal of the latch 131 for causing the transistor 132 to be made ON. Thus, the valve 99 is energized to have position where the vacuum operating chamber 94 is connected to the vacuum take-out port 98, causing the diaphragm 90 to be displaced against the force of the spring 92. Thus, the by-pass valve 86 is opened to open the by-pass 84. Thus, a diversion of air from the supercharger to the by-pass occurs, to decrease the effort to drive the supercharger, which increases fuel consumption efficiency. See the single shaded area in FIG. 6.

When Q/N is larger than c, the engine is under a high load condition where supercharging is really required. In this case, the program goes to the previously mentioned point 310, where the by-pass 84 is closed. Thus, a full amount of air from the supercharger is introduced into the engine to obtain the maximum supercharging effect and high engine power. See the double shaded are in FIG. 6.

According to the present invention, the by-pass 84 is maintained closed, when the supercharger 60 is in its rest condition (no shaded area in FIG. 6). The control of the by-pass is attained only when the supercharger is operated. This means that the by-pass is maintained in a closed position when the clutch is to be engaged. Due to the closed condition of the by-pass, a full amount of air is passed through the supercharger 60, and a high rotational speed of the supercharger is maintained during the state of clutch release. Thus, the drop in the rotational speed of the supercharger due to inertia is minimized when the clutch is engaged. Therefore, it becomes easy to smoothly accelerate the engine.

In the embodiment, Q/N is measured to detect engine load. However, other parameters, such as the intake vacuum or degree of throttle opening, can be measured in order to detect the engine load.

In place of a combination of the vacuum operated valve 86 and the solenoid valve 99, just a solenoid valve can be employed.

While the present invention is described with reference to the attached drawings, many modifications and changes can be made by those skilled in this art without departing from the scope and spirit of the present invention.

What is claimed is:

1. An internal combustion engine comprising;

an engine body;

an intake system connected to the engine body for introducing air into the engine body;

an exhaust system connected to the engine body for removal of the combustion product from the engine body;

a mechanical pump arranged as a supercharger in the intake system;

clutch means for connecting kinematically the supercharger to the engine for driving the supercharger;

actuator means responsive to at least engine load for selectively operating the clutch means;

a by-pass having a first end connected to the intake system at a position downstream of the supercharger and a second end connected to the intake system at a position upstream from the supercharger;

by-pass valve means arranged in the by-pass for controlling the flow of bypass air into the by-pass from the supercharger;

first means for producing a by-pass operating singal directed to the bypass valve means for closing the bypass when the engine load is high; and second means for producing a by-pass operating signal directed to the bypass valve means for closing the by-pass during the low load condition of the engine.

2. An internal conbustion engine according to claim 1, wherein said supercharger comprises a Roots blower having a plurality of rotors rotating with a small gap therebetween.

3. An internal combustion engine according to claim 1, wherein said actuator means comprises detector means for detecting an engine parameter, related at least to the enging load, and actuating means, responsive to signals from the detector means, for providing signals directed to the clutch means.

4. An internal combustion engine according to claim 3, wherein said detector means comprise a first sensor for detecting engine load, a second sensor for detecting a engine speed, and means for producing a signal directed to said actuating means when the engine load is higher than a predetermined value or the engine speed is higher than a predetermined value.

5. An internal combustion engine according to claim 1, wherein said by-pass valve means has valve means arranged in the by-pass for controlling the by-pass operation, a vacuum actuator means connected to the valve means, and vacuum switching valve means responsive to the by-pass operating signal for controlling the vacuum level in the vacuum actuator means.

6. An internal combustion engine according to claim 1, wherein said first means produces the by-pass operating signal when the engine load has increased to a value larger than a value for commencing the engagement of the clutch means.

7. An internal combustion engine according to claim 1, wherein said second means comprises means for detecting a released condition of the clutch means and means issuing the by-pass operating signal upon the detection of the release of the clutch means.

* * * * *